US006168876B1

(12) United States Patent
Thorp et al.

(10) Patent No.: US 6,168,876 B1
(45) Date of Patent: Jan. 2, 2001

(54) BACKLIGHTED FLUORESCENT/ RETROREFLECTIVE SAFETY DEVICE

(76) Inventors: Elizabeth M. Thorp; Stephen N. Thorp, both of 5060 Porpoise Pl., New Port Richey, FL (US) 34652

( * ) Notice: Under 35 U.S.C. 154(b), the term of this patent shall be extended for 0 days.

(21) Appl. No.: 08/212,065

(22) Filed: Mar. 15, 1994

Related U.S. Application Data

(63) Continuation-in-part of application No. 08/059,572, filed on May 12, 1993, now abandoned.

(51) Int. Cl.[7] ..... G09F 13/22

(52) U.S. Cl. ..... 428/690; 359/527; 359/530; 359/536; 359/537; 428/691; 428/917

(58) Field of Search ..... 428/690, 691, 428/917; 359/527, 530, 536, 537

(56) References Cited

U.S. PATENT DOCUMENTS 3,802,944 * 4/1974 Tung ..... 161/3.5
3,952,690 * 4/1976 Rizzo ..... 116/63 P
5,243,457 * 9/1993 Spencer ..... 119/795
5,300,783 * 4/1994 Spencer et al. ..... 250/462.1

OTHER PUBLICATIONS

Promotional Literature from Loitite Luminescent System, Inc.

a) You Can Do More With Our EL Lamps Than Any Other Light.

b) For Our EL Lamp, There's No Such Thing as a Hostile Environment.

* cited by examiner

*Primary Examiner*—Ellis Robinson
(74) *Attorney, Agent, or Firm*—W. Stanley Alexander

(57) ABSTRACT

An improved, "fail-safe" safety device comprising, in combination, a backlighted fluorescent film and a retroreflective sheet.

4 Claims, No Drawings

BACKLIGHTED FLUORESCENT/ RETROREFLECTIVE SAFETY DEVICE

This application is a continuation-in-part of U.S. patent application Ser. No. 08/059,572, filed May 12, 1993 now abandoned.

This invention relates to novel structures, useful, inter alia, as safety devices, which combine the desirable features of fluorescence, retroreflectivity and electroluminescence in a single structure. In a specific embodiment, the invention relates to highway safety and traffic control devices.

The use of fluorescent materials for improved daylight visibility and conspicuity is well known and is commonly practiced in such applications as hunter's vests, highway worker safety vests and plastic traffic control cones. Such materials use special dyes and pigments, which convert low wavelengths of light energy to higher wavelengths, thereby providing color emphasis, which offers good contrast with surroundings and, thus, higher visibility.

The use of retroreflective materials for improved nighttime visibility and conspicuity to improve safety conditions is also well known and is commonly practiced in applications such as highway signs and reflective strips attached to clothing and safety vests.

The use of fluorescent and retroreflective materials in combination for improved daytime and nighttime visibility also has been used commercially for many years. For example, the triangular slow moving vehicle emblem specified for use on vehicles traveling the highway at less than twenty-five miles per hour is composed of a center triangle made from fluorescent film and a border of retroreflective sheet. This design has been used for many years and is recognized internationally.

The U.S. Coast Guard places signs along the waterways consisting of various configurations of fluorescent film and retroreflective sheet in combination for both daytime and nighttime visibility.

The above illustrations represent the use of fluorescent and retroreflective materials in essentially the same plane, so that the fluorescent material and the retroreflective material are essentially side-by-side in the same device. This generally has been necessary, since, due to the construction of most retroreflective films, retroreflective film placed over a fluorescent film masks the corresponding fluorescent area, converting the fluorescent area to a retroreflective area. On the other hand, many fluorescent films and devices are opaque, precluding their use over retroreflective films.

Recently, transparent or translucent fluorescent films or constructions have been offered to the market which make possible the preparation of unique products. Such a fluorescent film can be superimposed directly over a retroreflective film, providing the combination of retroreflectivity and fluorescence in the same area without total sacrifice of either phenomenon. Although some compromises may be required when the single construction is used for both functions, the net effect is a material or construction that provides the desired combined characteristics of both daytime and nighttime visibility.

The concept of combining a fluorescent film over a retroreflective sheet is disclosed in U.S. Pat. No. 3,830,682, issued Aug. 20, 1974 to William P. Rowland. This technology is produced commercially by several firms and sold under trade names such as Reflexite ("Reflexite Corp), "RTC" (Avery International) and reflectorized "Stabrite" (SMV Technologies, Inc.) and Scotchlite Diamond Grade reflective sheet (Minnesota Mining and Manufacturing Co.).

The above examples of fluorescent and retroreflective products depend on incident light such as daylight (for fluorescent material) or an artificial light source such as an automobile headlamp (for retroreflective material) to provide visibility. The light must impinge on the face of the material to provide the desired daytime or nighttime visibility.

Nighttime visibility of a fluorescent film can be enhanced by placing a light source, such as an ordinary incandescent light bulb, behind a fluorescent film. The nighttime visibility of such a device can be increased by increasing the brightness of the light source or by increasing the transparency of the fluorescent film.

The development of electroluminescent light sources has provided a new degree of freedom in the preparation of backlighted fluorescent constructions. Electroluminescent lamps are characterized by low electric current consumption, good mechanical durability and the ability to be bent to conform to curved surfaces so long as the radius of curvature of the surface is greater than the curvature tolerance of the lamp. A further feature, which makes electroluminescent lamps particularly well suited for use with fluorescent films and constructions is that the light is emitted over a wide area rather than from a point source. This permits production of unique constructions, such as backlighted fluorescent films for both daytime and nighttime visibility, which may be considered as "active" rather than "passive" in their nighttime visibility modes. Conspicuity may be further improved by turning the lamp on and off periodically.

The backlighted fluorescent film provides the combination of a passive daytime device of high visibility with an active nighttime device of high visibility. The deficiency of such a device is that, in the event of a failure of the lamp, such as from interruption of the power source, the nighttime visibility is dramatically reduced and the device can no longer call attention to a hazard.

In accordance with this invention, there is provided a backlighted structure that combines the properties of fluorescence, retroreflectivity and electroluminescence in a single device whereby both daytime and nighttime visibility are markedly improved. Specifically, the invention is a composite structure comprising a source of electroluminescent light and, superimposed on said source, a translucent or transparent fluorescent film and, in close proximity thereto, a retroreflective film. The retroreflective film can be either superimposed on the light source or adjacent to it in the same plane.

The composite structure of this invention overcomes the deficiency of known electroluminescent-backed fluorescent films by providing retroreflectivity from incident light (e.g. automobile headlights) in the event of electrical power failure. The retroreflective film provides the device with a "fail safe" feature.

Since the retroreflective film does not depend on the light source for the effect that it produces, it need not be superimposed on the light source as is the fluorescent film. It can be superimposed on the light source if desired, either atop or under the fluorescent film, but it can also be placed adjacent to the fluorescent film and in substantially the same plane, e.g., in the presently used slow moving emblem. The retroreflective and fluorescent features of the film can also be combined into a single film, which is superimposed on the light source.

One embodiment of a structure according to this invention is the use of an electroluminescent light source behind the fluorescent center of a slow moving vehicle emblem. This structure provides the visibility of daytime fluorescence when the electroluminescent source provides minimal, if any, increase in visibility, with an active device which provides visibility when ambient lighting is not sufficient to provide the desired level of visibility. This structure is enhanced by the "fail-safe" feature of passive nighttime visibility from the retroreflective film, all in one device.

Another embodiment of a structure according to the invention is an elongated flexible structure that can be wrapped around a person or inanimate cylindrical surfaces such as construction zone barrels, trees or other such potential traffic hazards.

A significant advantage of such a construction is that the luminance of electroluminescent lamps tends to be low relative to incandescent lamps such as automobile headlights or even a good quality flashlight. The brightness of the retroreflective material under high intensity illumination, such as automobile headlights, can be far brighter than an electroluminescent lamp. Thus, the passive "fail safe" feature enhances the total visibility of the structure.

Retroreflective constructions are generally divided into three categories:

1) Enclosed lens glass beaded—This construction consists essentially of a transparent film backed with glass beads, a spacer film and a reflective aluminized film. The glass beads focus the incident light on the aluminized film, whence it is reflected back toward the source.

2) Encapsulated glass beaded—This construction is similar to the enclosed lens glass beaded film but instead of the glass beads being in direct contact with the surface of the top film, there is an air interface. The improved refraction of light passing from the air into the glass enables the focusing to take place at the back of the glass bead. Thus the need for a spacer coat between the beads and the aluminized film is eliminated. This structure results in more efficient retroreflection of the incident light enabling the film to appear brighter when illuminated.

3) Cube corner—The physics of design of cube corner retroreflectors make them the most efficient and they provide the brightest type of retroreflective film. A significant characteristic of this design is that metalization is not required, although it may be used. Normally there is an air interface to the cube corners.

Both the encapsulated glass bead and the cube corner designs are similar in that they have air interfaces. This air interface must be protected against contact from water in order to maintain its efficiency. This normally is accomplished by dividing the surface into small segments of a design that will isolate one segment from another. In the event of mechanical failure of one segment resulting in water intrusion, the entire surface is not destroyed. Protection of the air interface is normally accomplished by bonding a secondary film to the perimeters of the design separating one segment from another.

Both the enclosed glass bead and the encapsulated glass bead structures are normally metalized to maximize the retroreflectivity. A disadvantage of this type of structure is that it is not possible to backlight the construction in order to pass light through it and to obtain an active and passive nighttime visible construction. The metalization which performs so well in improving the retroreflectivity serves to prevent light passing through the structure from back to front by the same process as it helps to improve the return of light entering from the front and exiting out the front. This film is only employed when the retroreflective element of the structure is placed adjacent in the same plane as the backlit fluorescent element.

A unique feature of the cube corner design retroreflectors is that metalization is not normally used, therefore it is possible to position a light behind the structure so that the film can be made both active and passive for nighttime visibility. This film is employed when the retroreflective element is superimposed on the light source and the fluorescent element.

In order to obtain enhanced performance of the fluorescent portion of the film, commercial fluorescent retroreflective constructions commonly use a white backing film to seal the individual segments against the intrusion of water. While such a film provides an enhanced daytime appearance, it negatively impacts light transmission through the structure from rear to front, which is essential for active nighttime visibility. Examples of such constructions are certain commercial grades of "Reflexite" reflective sheeting and "Scotchlite" Diamond Grade reflective sheeting.

Light transmission from rear to front can be enhanced by eliminating the translucent white barrier film and having only an air interface between the cube corners and the light source.

Alternatively, rear lighted performance can be obtained by interrupting the aluminized layer behind the beads in either a closed or encapsulated glass beaded retroreflective sheet. Although the retroreflective efficiency of such a structure is reduced, it is still possible to produce a structure that will be both retroreflective and lighted for active and passive nighttime visibility.

The invention is illustrated by the following non-limiting examples.

EXAMPLE 1

A sheet of "Stabrite" fluorescent vinyl film, manufactured by SMV Technologies, was bonded to a "Lifeline" electroluminescent lamp (Loctite Electroluminescent Systems, Inc.) in the shape of a triangle. This lamp was used to produce a structure conforming to the specification of the slow moving vehicle emblem as defined by the American Society of Agricultural Engineers standard 276.3. The unit was powered with a standard electrical source, which delivered 115 volts A.C. and 400 Hz to the lamp. The composite modified slow moving vehicle emblem was then viewed under daytime and nighttime conditions. While continuing to conform to the current ASAE standards, it was also highly visible at night without the illumination of an automobile headlight.

EXAMPLE 2

A sheet of "Kiwalite" encapsulated lens glass beaded film (Kiwa Chemical Industries Company Ltd.) was covered with "Stabrite" fluorescent vinyl film. The composite structure was highly visible under daylight when illuminated by natural light. When illuminated with automobile headlamps it was highly visible due to its retroreflectivity. Because of the discontinuous nature of the metalized backing of the structure, it was bonded to a "Lifeline" electroluminescent lamp, and was found to be visible without headlamp illumination. However, because the retroreflective properties had not been compromised, the entire structure remained highly visible under nighttime conditions when illuminated with automobile headlamps, regardless of whether the electroluminescent lamp was on or off.

EXAMPLE 3

A sheet of "Scotchlite" orange colored Diamond Grade reflective sheeting was bonded to a "Lifeline" electroluminescent lamp. The material was highly visible in the daytime when illuminated with natural light. It was also highly visible at night when illuminated with automobile headlamps. When the electroluminescent lamp was on, the material was highly visible without illumination with automobile headlamps. The structure remained highly visible under the illumination of the automobile headlamps, whether the electroluminescent lamp was on or off.

EXAMPLE 4

A sheet of "Scotchlite" orange colored Diamond Grade reflective sheeting was modified by careful removal of the protective white backing film. The resulting highly transparent film was then bonded to an electroluminescent lamp using the high points in the film design which are normally bonded to the white protective film. The resulting device was highly visible under daylight conditions and highly visible under nighttime conditions when illuminated with automobile headlamps. When the electroluminescent lamp was lit, the material was highly visible without illumination by automobile headlamps. The structure remained highly visible under the illumination of the automobile headlamps whether the electroluminescent lamp was on or off. The brightness of the lamp was dramatically improved by elimination of the translucent white backing layer.

EXAMPLE 5

A fluorescent, retroreflective film of the type disclosed by Rowland in U.S. Pat. No. 3,380,862 was secured to the surface of a "Lifeline" electroluminescent lamp. This structure exhibits a high degree of visibility under daytime light conditions. At night the device is highly visible when the electroluminescent lamp is activated. The device is also highly visible under the influence of automobile headlamps or another outside source of artificial light, when the electroluminescent lamp is out. This high degree of visibility is apparent even when the lamp is not directly in the approach path of the outside light source. When the device is directly in the path of the light source, there is a dramatic increase in the visibility of the device due to the incident light being reflected back toward the source. This high degree of retroreflectivity is observed whether the electroluminescent lamp is activated or out.

EXAMPLE 6

To the surface of a "Lifeline" electroluminescent lamp there was secured, immediately adjacent to the lamp surface, a clear, cube corner retroreflective film (Diamond Grade Scotchlite). On the surface of the clear retroreflective film was secured a translucent fluorescent film (SMV 6100 from SMV Technologies, Newark, Del.) Though the retroreflective and fluorescent qualities are contributed by different films, located in different layers, the device exhibited a high degree of both active and passive fluorescence and a high degree of retroreflectivity.

EXAMPLE 7

To the surface of a "Lifeline" electroluminescent lamp there was secured, immediately adjacent to the lamp surface, a translucent fluorescent film (SMV 6100 from SMV Technologies, Newark, Del.). On the surface of the fluorescent film was secured a clear, cube corner retroreflective film (Diamond Grade Scotchlite). The fluorescent color of this device was not readily visible in the passive, daylight mode. When the electroluminescent lamp was activated at night, the device exhibited a good degree of fluorescence. When struck by incident light, it retroreflected light of the same color as the light source shining on it.

EXAMPLE 8

To the surface of a "Lifeline" electroluminescent lamp, measuring approximately one inch wide by four feet long, there was secured "Reflexite" translucent fluorescent cube corner retroreflective film. This structure was wrapped around the trunk of a tree. In the dark of night with the electroluminescent lamp activated, the circumference of the tree was readily visible from any direction. When illuminated with automobile headlights, the cube corner retoreflector caused a dramatic increase in the visibility of the section of the tree impinged by the beams of the headlight. In addition, the action of the activated lamp continued to make the circumference of the tree readily visible.

What is claimed is:

1. A composite structure comprised of an electroluminescent light source and, superimposed on said light source, a retroreflective sheet and, superimposed on said retroreflective sheet, a translucent or transparent fluorescent film.

2. A composite structure according to claim 1 wherein the retroreflective sheet is an encapsulated lens glass beaded retroreflective sheet.

3. A composite structure according to claim 1 wherein the retroreflective sheet is a cube corner retroreflective sheet.

4. A composite structure comprised of an electroluminescent light source and, superimposed on said source, a fluorescent, retroreflective film.

* * * * *